US005732860A

United States Patent [19]

Faraj

[11] Patent Number: 5,732,860

[45] Date of Patent: Mar. 31, 1998

[54] SPORTS UTILITY BELT

[76] Inventor: Abdul-Razzak Faraj, P.O. Box 566068, Atlanta, Ga. 31156

[21] Appl. No.: 767,946

[22] Filed: Dec. 17, 1996

[51] Int. Cl.[6] ..... A45F 5/00

[52] U.S. Cl. ..... 224/148.2; 224/148.6; 224/682; 224/664; 224/903

[58] Field of Search ..... 224/148.1–148.7, 224/903, 660, 663, 664, 676, 677, 678, 679, 681, 682, 684, 235, 236, 250; 190/108; 150/111, 102; D3/215, 221, 226, 229, 230; 222/175

[56] References Cited

U.S. PATENT DOCUMENTS

| | | | |
|---|---|---|---|
| D. 333,570 | 3/1993 | Murray | D3/226 |
| D. 333,729 | 3/1993 | Hopp | D3/226 |
| 551,359 | 12/1895 | Braillard | 224/660 |
| 1,478,497 | 12/1923 | Welch | 224/660 |
| 1,692,200 | 11/1928 | Capuano | 224/903 |
| 1,729,578 | 9/1929 | Gogan | 224/903 |
| 4,139,130 | 2/1979 | Glusker et al. | 224/148.2 |
| 4,449,654 | 5/1984 | Cappis | 224/148.2 |
| 4,953,674 | 9/1990 | Landes | 190/108 |
| 4,966,320 | 10/1990 | DeSantis et al. | 224/684 |
| 5,060,835 | 10/1991 | Payne | 224/148.2 |
| 5,294,031 | 3/1994 | Volpei et al. | 224/664 |
| 5,301,858 | 4/1994 | Hollander | 224/148.2 |
| 5,535,797 | 7/1996 | Martindale | 150/111 |

*Primary Examiner*—Henry J. Recla
*Assistant Examiner*—Gregory M. Vidovich
*Attorney, Agent, or Firm*—John L. James

[57] ABSTRACT

A sports utility belt has a central body with first and second end portions and a middle portion intermediate the end portions. A strap has one end connected to the first end portion of the central body and a free distal end. The strap is extendible between a retracted position at which the distal end contacts the central body and an extended position at which the distal end is spaced from the central body. A key pouch is attached to the distal end of the strap and movable with the distal end between a retracted position at which the key pouch contacts the central body and an extended position at which the key pouch is spaced from the central body. The second end portion receives a watch or cardiovascular monitoring device. The central body is adapted to receive a water bottle to be carried with the user for convenience. A drinking tube is provided so that the user can drink while wearing the belt.

15 Claims, 2 Drawing Sheets

SPORTS UTILITY BELT

FIELD OF THE INVENTION

The present invention relates generally to exercise equipment and sporting goods, and, more particularly, to a utility belt for use during exercise or sporting events.

BACKGROUND OF THE INVENTION

When participating in sports activities and during regular exercise, it is important to maintain body fluids. There are many containers available for transporting and storing water for use during physical activity. A problem with many of these containers is that the user must interrupt activity to use the container. There are squeeze bottles that can be carried by the user and used without interrupting activity. Unfortunately, the squeeze bottles must be carded using the hands or suspended from a shoulder strap. It is desirable to have the hands free during activity and to be free of shoulder straps that interfere with movement or make annoying contact with the user.

When exercising, especially walking or jogging, the clothing used does not provide pockets for carrying identification or other items. Unfortunately, there is no pocket for essential items such as keys, or where there is a pocket, the keys annoyingly bounce against the body or rattle. Where there is no rattling, as in the case of a single key, the user continuously checks for the key. While a key could be carried on a necklace, many find it distracting.

When performing a cardiovascular workout, the exercise period must be measured. A wrist watch on the wrist is unsuitable because it is subject to damage from both shock and perspiration, but, more importantly, it can constrict blood flow causing the heart to beat faster than otherwise required or with an increase in blood pressure that is undesirable. Where exercise clothing has no pockets, time cannot be properly monitored, and maximum exercise benefit cannot be achieved. Accordingly, it will be appreciated that it would be highly desirable to have a device for carrying keys, water and equipment to facilitate monitoring respiration and pulse.

SUMMARY OF THE INVENTION

The present invention is directed to overcoming one or more of the problems set forth above. Briefly summarized, according to one aspect of the present invention, a sports utility belt comprises a central body having first and second end portions and a middle portion intermediate the end. A strap has one end connected to the first end portion of the central body portion and a free distal end, and is extendible between a retracted position at which the distal end contacts the central body and an extended position at which the distal end is spaced from the central body. A key pouch is attached to the distal end of the strap and movable with the distal end between a retracted position at which the key pouch contacts the central body and an extended position at which the key pouch is spaced from the central body. Means are provided on the central body for carrying a water storage device.

The water storage device has a drinking tube for use while wearing the belt without interrupting activity. Keys or coins may be conveniently kept in the key pouch without rattling. A time piece or cardiovascular monitoring device may be attached to the belt at a location provided on the second end portion.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENTS

Figure 1:
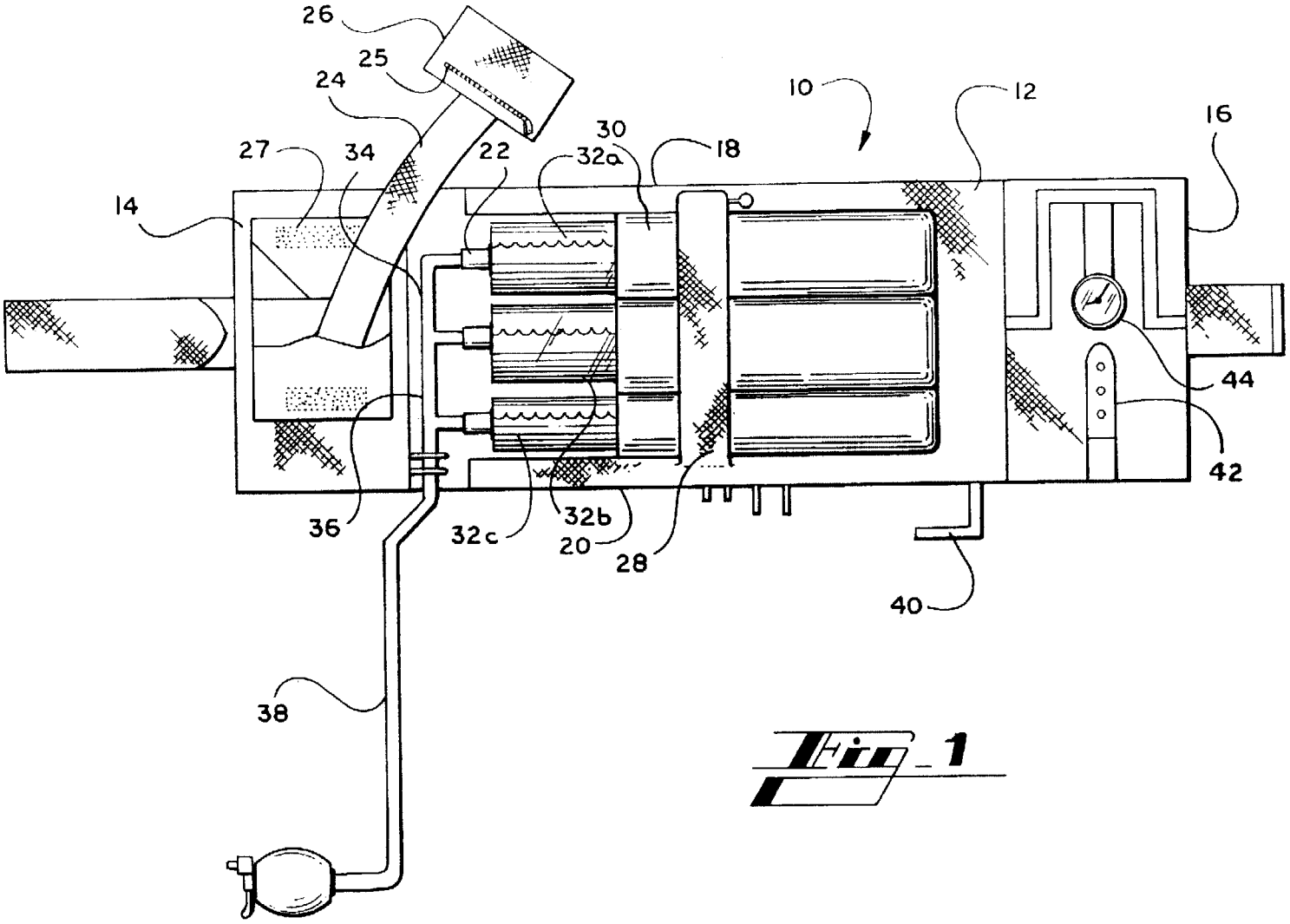
FIG. 1 is a diagrammatic view of a preferred embodiment of a utility belt according to the present invention.

Referring to FIG. 1, a sports utility belt 10 is constructed of a strong, breathable fabric material. The belt 10 has a central body portion 12 with first and second end portions 14, 16, upper and lower edge portions 18, 20, and a middle portion 22 intermediate the end portions 14, 16 and the edge portions 18, 20. The ends of the end portions 14, 16 are fitted with hook and loop fasteners to form an adjustable closure for attaching about the body of the user.

A strap 24 has one end connected to the first end portion 16 of the central body 12 by sewing or the like, and a free distal end. It is extendible between a retracted position at which the distal end contacts the central body and an extended position at which the distal end is spaced from the central body. The strap may be constructed of the same material as the central body or may be formed of an elastic material. A key pouch 26 is attached to the distal end of the strap 24 and movable with the distal end between a retracted position at which the key pouch 26 contacts the central body 12 and an extended position at which the key pouch is spaced from the central body 12. Pouch 26 may be closed by a zipper 25 or other fastener, or may contain a fold over flap. The pouch may be fitted with a hook and loop fastener so that at the retracted position it attaches to the first end portion of the central body. More preferably, a pouch 27 sewn to the first end portion of the central body receives the key pouch 26 at the retracted position. Pouch 26 or 27 can be made large enough to carry a wallet or identification card.

A flap 28 is attached to the central body 12 along the lower edge portion 20 and releasably fastened to the central body 12 along the upper edge portion 18. Preferably, flap 28 holds a bottle holder 30 in position between flap 28 and central body 12, but may be wide enough to hold a water bottle 32 in position alone without a bottle holder 30. Preferably, a bottle holder 30 is used that has a plurality of compartments each capable of holding a single water bottle. As illustrated, there are three single water bottles, **32*a*, 32*b*, 32*c* interposed between the bottle holder 30 and central body 12. Water bottle 32*a* is connected by transfer tube 34 to bottle 32*b* which is connected by transfer tube 36 to bottle 32*c*. Bottle 32*a* is at a higher elevation than bottle 32*b* which is at a higher elevation than bottle 32*c* so that water flows from bottle 32*a* to bottle 32*b* and from bottle 32*b* to bottle 32*c***.

A drinking tube 38 is provided for extracting water from water bottle **32*c*, which is at the lowest elevation to receive water from the other two bottles. Drinking tube 38 has one end connected to water bottle 32*c* and has a distal end portion that pivots about its connected end. Drinking tube 38 is moveable between a retracted position at which the tube lies along one of the upper and lower edge portions and an extended position at which the distal end portion is pivoted away from the central body. The pivoting may occur at the connection of the drinking tube to bottle 32*c*, or may occur at the upper or lower edge of the central body 12. Preferably, a drinking tube holder 40** is attached to the lower edge portion of the central body for holding the tube in the retracted position.

Figure 2:
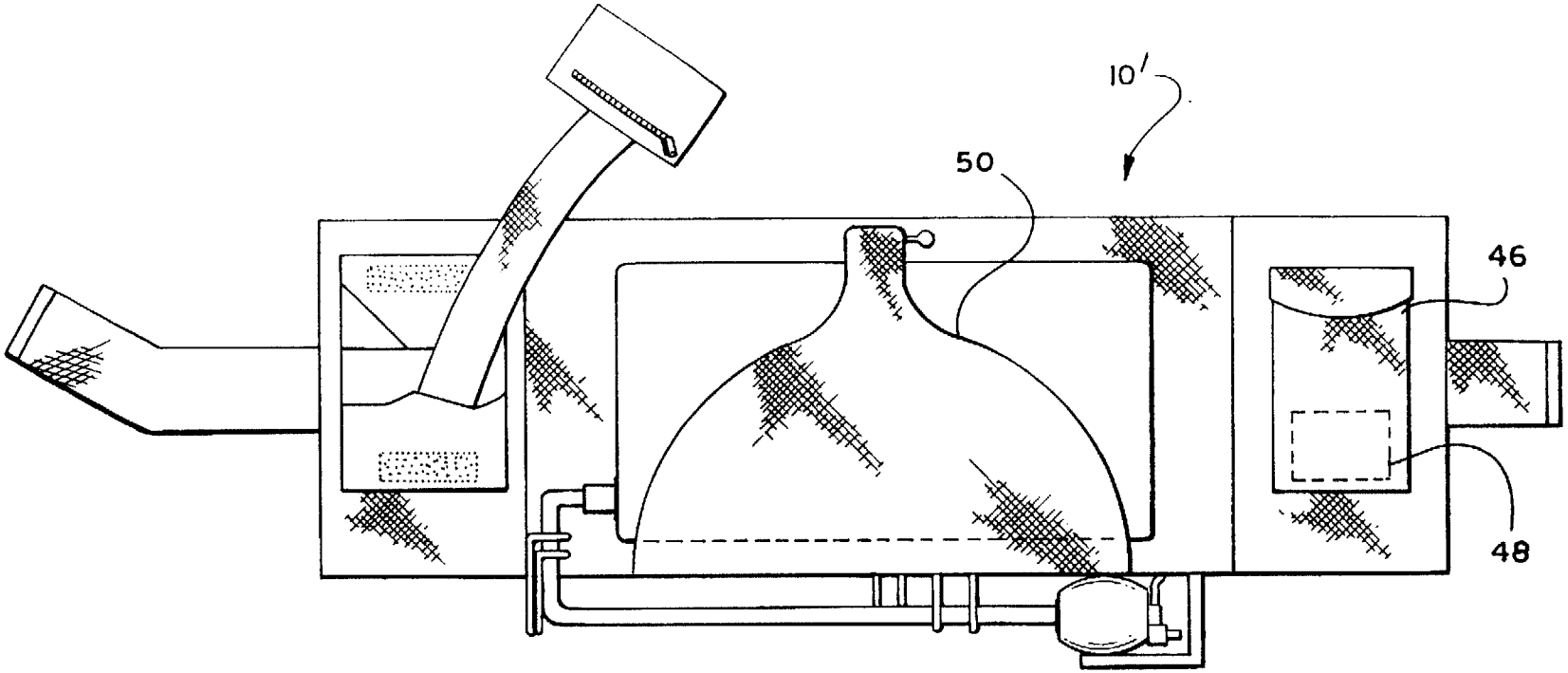
FIG. 2 is a diagrammatic view similar to FIG. 1 but illustrating another preferred embodiment.

The second end portion 16 of the central body preferably has attached thereto a small belt 42 and buckle 44 suitable for attaching a users wrist watch FIG. 1). Alternatively, a piece of material is sewn to the second end portion forming a pouch 46 (FIG. 2). Pouch 46 can be used for holding a stop watch, wrist watch, heart monitor, or other exercise monitoring equipment. Hook and loop fasteners 48 can be attached to the second end portion to mate with hook and loop fasteners on a watch or other device.

FIG. 2 shows a sports utility belt 10' wherein the means for carrying a water storage device is a pouch 50. Pouch 50 may be in the form of a flap fastened along the bottom edge of the central body and releasably connected to the top edge portion of the central body, or may be a piece of material sewn to the central body.

It can now be appreciated a sports utility belt has been presented. It contains a central body portion with end portions, edge portions, and a middle portion intermediate the end portions and the edge portions. A strap has one end connected to the first end portion of the central body and a free distal end with the strap being extendible between a retracted position at which the distal end contacts the central body and an extended position at which the distal end is spaced from the central body. A key pouch is attached to the distal end of the strap and movable with the distal end between a retracted position at which the key pouch contacts the central body and an extended position at which the key pouch is spaced from the central body. A flap is attached to the central body portion along the lower edge portion and releasably fastened to the central body along the upper edge portion. A bottle holder has a plurality of compartments each capable of holding a single water bottle interposed between the flap and the central body. A drinking tube extracts water from one of the single water bottles. It has one end connected to the one single water bottle and has a pivotal distal end portion. The drinking tube pivotally moves between a retracted position at which the tube lies along the lower edge portion and an extended position at which the distal end portion is pivoted away from the central body.

The sports utility belt provides a place to keep keys, a watch and a water bottle. The water can be sipped through a retractable drinking tube while wearing the belt and while walking or jogging. Wrist watches may be buckled to the belt or carded in a pouch also suitable for a pocket watch or a radio. A wallet or identification can be carded in the key pouch or attached with hook and loop fasteners. Keys can be carded without rattling.

While the invention has been described with particular reference to the preferred embodiments, it will be understood by those skilled in the art that various changes may be made and equivalents may be substituted for elements of the preferred embodiments without departing from invention. For example, while nylon is preferred for the belt, other breathable fabric materials may be used. In addition, many modifications may be made to adapt a particular situation and material to a teaching of the invention without departing from the essential teachings of the present invention.

As is evident from the foregoing description, certain aspects of the invention are not limited to the particular details of the examples illustrated, and it is therefore contemplated that other modifications and applications will occur to those skilled in the art. It is accordingly intended that the claims shall cover all such modifications and applications as do not depart from the true spirit and scope of the invention.

What is claimed is:

1. A sports utility belt, comprising: a central body having a lowered portion and an upper edge portion, first and second end portions and a middle portion intermediate said end portions;

a strap having one end connected on said first end portion said central body and a free distal end, said strap being between a retracted position at which said distal end contacts said central body and an extended position at which said distal end is spaced said central body;

a key pouch attached to said distal end of said strap and movable with said distal end between a retracted position at which said key pouch contacts said central body and an extended position at which said key pouch is spaced from said central body;

means on said central body for carrying a water storage device, said means for carrying a water storage device including a flap attached to said central body along said lower edge portion and releasably fastened to said central body along said upper edge portion; and a bottle holder, interposed between said flap and said central body, having a plurality of compartments each capable of holding a single water bottle.

2. A sports utility belt, as set forth in claim 1, including a security pocket attached to said first end portion of said central body, said strap having said one end connected to said security pocket, said key pouch resting within said pocket at said retracted position.

3. A sports utility belt, as set forth in claim 1, including a security pocket attached to said first end portion of said central body, said strap having said one end connected to said first end portion, said key pouch resting within said pocket at said retracted position.

4. A sports utility belt, as set forth in claim 1, including a tube for extracting water from said storage device, said tube having one end pivotally connected to said storage device and having a distal end portion, said tube being moveable between a retracted position at which the tube lies along one of said upper and lower edge portions and an extended position at which said distal end portion is pivoted away from said central body.

5. A sports utility belt, as set forth in claim 4, including a holder for holding said tube at said retracted position.

6. A sports utility belt, as set forth in claim 1, including means for attaching a watch to said second end portion of said central body.

7. A sports utility belt, comprising:

a central body having first and second end portions, upper and lower edge portions, and a middle portion intermediate said end portions and said edge portions;

a strap having one end connected on said first end portion of said central body and a free distal end, said strap being extendible between a retracted position at which said distal end contacts said central body and an extended position at which said distal end is spaced from said central body;

a key pouch attached to said distal end of said strap and movable with said distal end between a retracted position at which said key pouch contacts said central body and an extended position at which said key pouch is spaced from said central body;

a flap fastened to said central body along said lower edge portion and releasably attached to said central body along said upper edge portion; and a bottle holder having a plurality of compartments each capable of holding a single water bottle and being interposed between said flap and central body.

8. A sports utility belt, as set forth in claim 7, including means for attaching a watch to said second end portion of said central body.

9. A sports utility belt, as set forth in claim 7, including means for attaching a cardiovascular monitoring device to said second end portion of said central body.

10. A sports utility belt, as set forth in claim 7, including a tube for extracting water from one of said single water bottles, said tube having one end connected to said one single water bottle and having a pivotal distal end portion, said tube being moveable between a retracted position at which said tube lies along one of said upper and lower edge portions and an extended position at which said distal end portion is pivoted away from said central body.

11. A sports utility belt, as set forth in claim 7, including a security pocket attached to said first end portion of said central body, said strap having said one end connected to said security pocket, said key pouch resting within said pocket at said retracted position.

12. A sports utility belt, as set forth in claim 7, including a security pocket attached to said first end portion of said central body, said strap having said one end connected to said first end portion, said key pouch resting within said pocket at said retracted position.

13. A sports utility belt, comprising:

a central body having first and second end portions, upper and lower edge portions, and a middle portion intermediate said end portions and said edge portions;

a strap having one end connected to said first end portion of said central body and a free distal end, said strap being extendible between a retracted position at which said distal end contacts said central body and an extended position at which said distal end is spaced from said central body;

a key pouch attached to said distal end of said strap and movable with said distal end between a retracted position at which said key pouch contacts said central body and an extended position at which said key pouch is spaced from said central body;

a flap attached to said central body along said lower edge portion and releasably fastened to said central body along said upper edge portion;

a bottle holder having a plurality of compartments each capable of holding a single water bottle and being interposed between said flap and said central body;

a tube for extracting water from one of said single water bottles, said tube having one end connected to said one single water bottle and having a pivotal distal end portion, said tube being moveable between a retracted position at which said tube lies along one of said upper and lower edge portions and an extended position at which said distal end portion is pivoted away from said central body; and means for connecting said single water bottles to one another so that their contents are extractable through said tube.

14. A sports utility belt, as set forth in claim 13, including means for attaching a time piece to said second end portion of said central body.

15. A sports utility belt, as set forth in claim 13, including means for attaching a cardiovascular monitoring device to said second end portion of said central body.

* * * * *